US007090563B2

(12) United States Patent
Matsumoto et al.

(10) Patent No.: US 7,090,563 B2
(45) Date of Patent: Aug. 15, 2006

(54) POLISHING METHOD

(75) Inventors: Satoshi Matsumoto, Toyama (JP); Yuichi Kurimoto, Osaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 11/233,053

(22) Filed: Sep. 23, 2005

(65) Prior Publication Data

US 2006/0073769 A1 Apr. 6, 2006

(30) Foreign Application Priority Data

Oct. 1, 2004 (JP) ..... 2004-289764

(51) Int. Cl.
*B24B 1/00* (2006.01)

(52) U.S. Cl. ..... 451/8; 451/56

(58) Field of Classification Search ..... 451/5, 451/8, 21, 103, 56

See application file for complete search history.

(56) References Cited

U.S. PATENT DOCUMENTS 6,910,943 B1 * 6/2005 Ishikawa et al. ..... 451/5
2001/0010999 A1 * 8/2001 Numoto ..... 451/8
2004/0072499 A1 * 4/2004 Wakabayashi ..... 451/5

FOREIGN PATENT DOCUMENTS

JP 2002-103202 4/2002

* cited by examiner

*Primary Examiner*—Jacob K. Ackun, Jr.
(74) *Attorney, Agent, or Firm*—McDermott Will & Emery LLP

(57) ABSTRACT

A polishing method includes the steps of: (a) polishing a to-be-polished object by moving an abrasive cloth relative to the to-be-polished object while pressing the to-be-polished object against the abrasive cloth; and (b) pressing a dressing member against the abrasive cloth moving relative to the to-be-polished object with the to-be-polished object pressed against the abrasive cloth and relatively moving the abrasive cloth and the dressing member, thereby dressing the abrasive cloth while polishing the to-be-polished object. The difference between the torque current of a motor in the step (a) and the torque current of the motor in the step (b) is determined, and when the determined difference falls below a previously set value is detected.

1 Claim, 4 Drawing Sheets

POLISHING METHOD

CROSS-REFERENCE TO RELATED APPLICATIONS

This application claims priority under 35 U.S.C. §119 on patent application Ser. No. 2004-289764 filed in Japan on Oct. 1, 2004, the entire contents of which are hereby incorporated by reference.

BACKGROUND OF THE INVENTION (1) Field of the Invention

The present invention relates to a method for polishing a semiconductor wafer or the like.

(2) Description of Related Art

In a polishing process for a semiconductor wafer or the like, an abrasive cloth is dressed using a dressing member during polishing to prevent the abrasive cloth from becoming clogged during polishing and keep the polishing rate constant. Abrasive diamond grains are typically embedded in a surface of the dressing member, and the abrasive cloth is dressed by cutting a surface of the abrasive cloth using the abrasive diamond grains.

With an increase in the time during which a dressing member is used, the ability of the dressing member to cut an abrasive cloth decreases due to the dropping off or the like of abrasive diamond grains. In this case, clogging of the abrasive cloth is not eliminated, resulting in the reduced polishing rate of a semiconductor wafer.

In a polishing process for a semiconductor wafer, it is very difficult to measure the amount of the semiconductor wafer polished during polishing. Therefore, a semiconductor wafer is typically polished using, as an index, the polishing time determined based on the target amount of the semiconductor wafer polished and the polishing rate. It is thus very significant to keep the polishing rate of the semiconductor wafer constant, and one dressing member need be appropriately replaced in a polishing process for a semiconductor wafer.

An interval at which a dressing member is replaced is set based on previously obtained correlation data between the time during which the dressing member is used or the number of processed semiconductor wafers and a process result, such as the polishing rate. A dressing member is replaced at the time when a process abnormality, such as the reduced polishing rate, is detected by periodically checking a wafer to be monitored.

On the other hand, attempts have been made to keep the amount of a semiconductor wafer polished constant by resetting the polishing time in accordance with reduction in the polishing rate. A method in which reduction in the polishing rate is estimated by monitoring the torque of a motor for rotating an abrasive cloth and the polishing time is accordingly reset to keep a predetermined amount of the semiconductor wafer polished is disclosed in, for example, Japanese Unexamined Patent Publication No. 2002-103202.

In this known method, when a dressing member is replaced on condition that the time during which a dressing member is used is fixed, an apparent life of a dressing member becomes shorter than an actual life thereof so that a still available dressing member is replaced. The reason for this is that dressing members themselves have individually different lives. Furthermore, when dressing members having a short life are used, one of the dressing members is replaced after a wafer to be monitored are checked for reduction in the polishing rate. As a result, the deterioration of the dressing member cannot be found until the wafer to be monitored is checked. Since the deterioration of the dressing member cannot therefore be previously sensed, an abnormally polished product might be produced.

In a method in which the polishing rate is estimated and the polishing time is varied according to the estimated polishing rate, the polishing time becomes long. Furthermore, in this case, the life of each dressing member is unspecified, and therefore the time at which the dressing member should be replaced cannot be determined.

SUMMARY OF THE INVENTION

The present invention has been made to solve the aforementioned conventional problems, and an object of the present invention is to provide a substrate polishing method which restrains abnormal polishing of a substrate due to the deterioration of a dressing member and in which the dressing member can be appropriately replaced according to individual differences among the lives of dressing members.

In order to achieve the above object, the present invention is configured such that a substrate is polished while the friction between a dressing member and an abrasive cloth in a dressing step of a polishing method is monitored.

More specifically, a polishing method of the present invention using a polishing apparatus including an abrasive cloth for polishing a to-be-polished object, a motor for moving the abrasive cloth relative to the to-be-polished object, and a dressing member for dressing the abrasive cloth, includes the steps of: (a) polishing the to-be-polished object by moving the abrasive cloth relative to the to-be-polished object while pressing the to-be-polished object against the abrasive cloth; and (b) pressing the dressing member against the abrasive cloth moving relative to the to-be-polished object with the to-be-polished object pressed against the abrasive cloth and relatively moving the abrasive cloth and the dressing member, thereby dressing the abrasive cloth while polishing the to-be-polished object, wherein the difference between the torque current of the motor in the step (a) and the torque current of the motor in the step (b) is determined, and when the determined difference falls below a previously set value is detected.

According to the polishing method of the present invention, since the magnitude of the friction produced between the dressing member and the abrasive cloth can be monitored, the deterioration of the dressing member can be detected based on reduction in the friction between the dressing member and the abrasive cloth. Therefore, the life of the dressing member can be accurately ascertained without being affected by individual differences among dressing members. This can prevent the abrasive cloth from becoming clogged due to a worn-out dressing member. As a result, the polishing rate can be kept constant. This can restrain abnormally polished products from being produced and prevent an available dressing member from being discarded, resulting in the reduced cost for polishing.

DETAILED DESCRIPTION OF THE INVENTION

Figure 1:
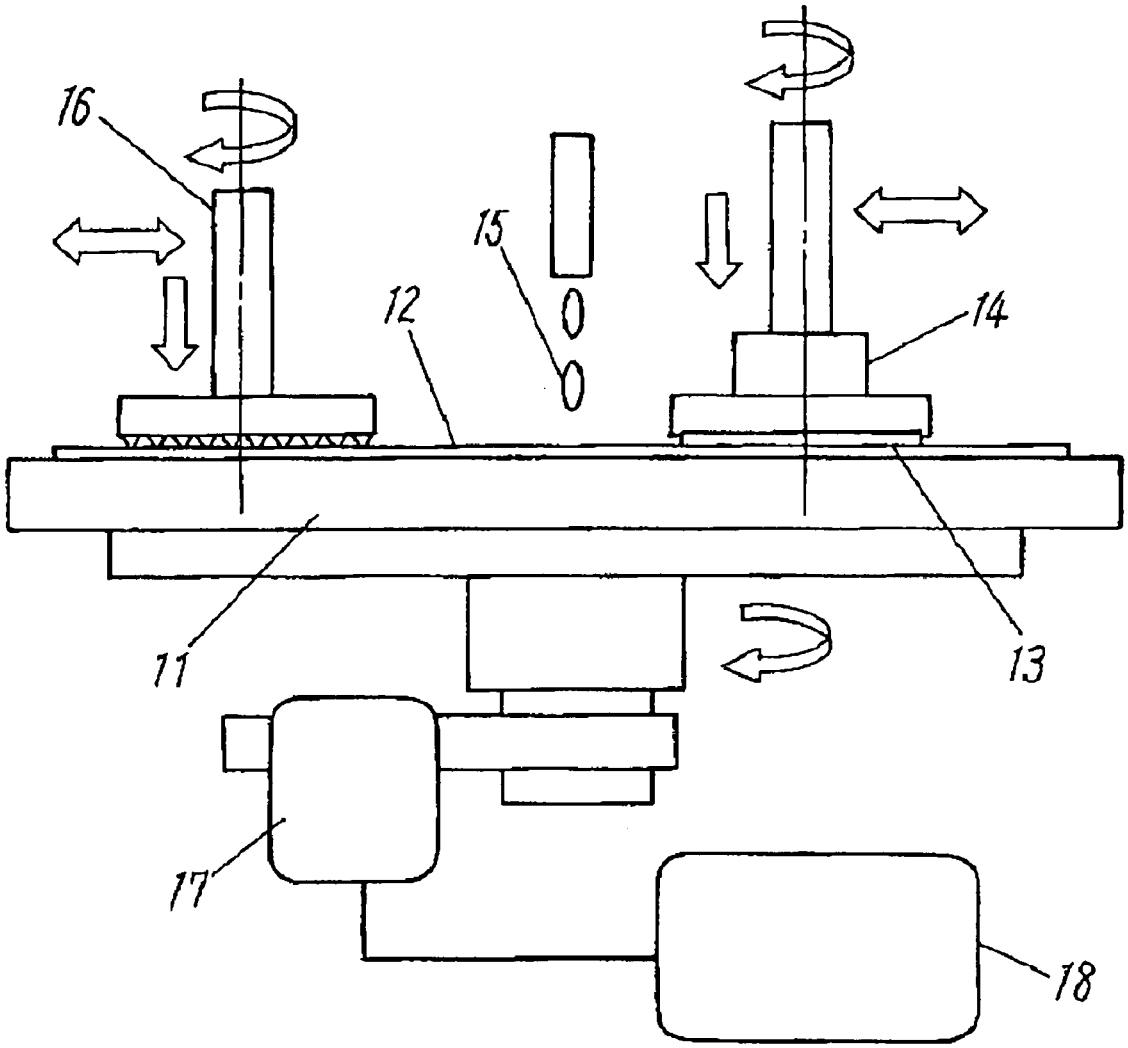
FIG. 1 is a schematic view showing a polishing apparatus used for a polishing method according to an embodiment of the present invention.

An embodiment of the present invention will be described with reference to the drawings. FIG. 1 schematically illustrates a polishing apparatus used for a polishing method according to the embodiment. As shown in FIG. 1, an object 13 to be polished (hereinafter, referred to as "to-be-polished object 13") is polished by pressing the to-be-polished object 13, such as a wafer, supported by a carrier 14 against a platen 11 to which an abrasive cloth 12 is bonded and supplying an abrasive 15 to the abrasive cloth 12 while rotating the platen 11 and the to-be-polished object 13. The abrasive cloth 12 is dressed by rotating a dressing member 16 while pressing the dressing member 16 against the abrasive cloth 12 during polishing.

Figure 2A:
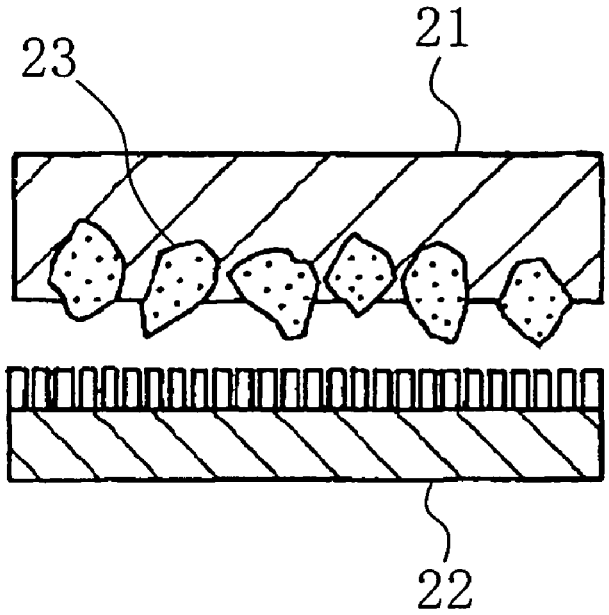
FIGS. 2A and 2B are a cross-sectional view showing the principal part of a dressing member used for the polishing method according to the embodiment of the present invention.
Figure 2B:
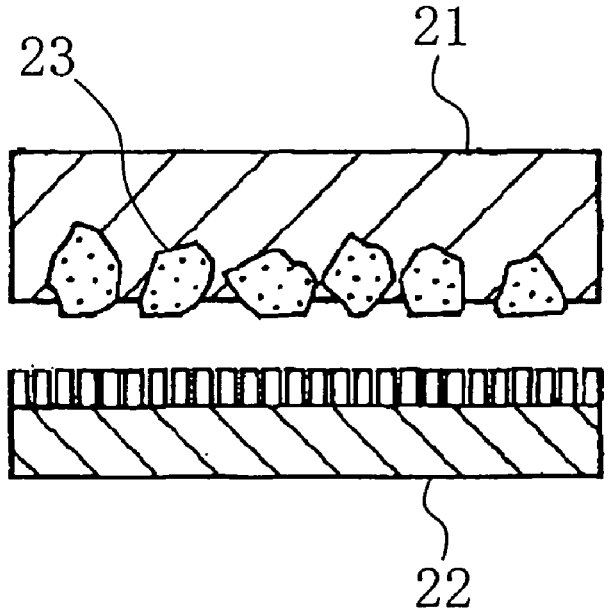

FIGS. 2A and 2B are cross-sectional views showing the principal part of a dressing member. FIG. 2A illustrates a new dressing member, and FIG. 2B illustrates a deteriorated dressing member. The dressing member includes a base 21 and abrasive grains 23 embedded in a surface of the base 21. Diamond is principally used as a material of the abrasive grains 23. The cutting faces of these abrasive grains 23 wear out or drop off with an increase in the time during which the dressing member is used, resulting in the reduced ability of the abrasive grains 23 to dress an abrasive cloth 12. This leads to the incompletely dressed abrasive cloth 12, resulting in the reduced polishing rate.

A motor 17 for rotating a platen 11 is connected to a monitoring tool 18 for measuring the torque current of the motor 17, and the torque current of the motor 17 during polishing is always monitored.

During polishing, the friction produced between the to-be-polished object 13 and the abrasive cloth 12 increases the torque current of the motor 17 for rotating the platen 11. A friction is produced also between the dressing member 16 and the abrasive cloth 12 by dressing the abrasive cloth 12 during polishing. This further increases the torque current of the motor 17 for rotating the platen 11.

On the other hand, the ability of the abrasive grains 23 to dress the abrasive cloth 12 is reduced due to the wearing out or dropping off of the abrasive grains 23 with an increase in the time during which the dressing member 16 is used, resulting in the reduced polishing rate. This decreases the friction between the dressing member 16 and the abrasive cloth 12, leading to the reduced increment of the torque current of the motor 17. The reduced increment of the torque current of this motor 17 is used as an index of deterioration of the dressing member 16, and this index serves as a guide for replacing the dressing member 16.

Figure 3:
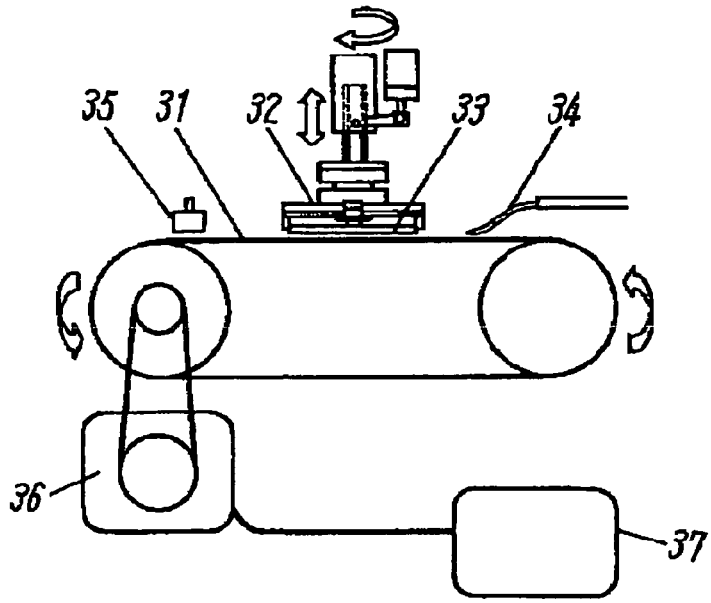
FIG. 3 is a schematic view showing another polishing apparatus used for the polishing method according to the embodiment of the present invention.

A description will be given below of an example in which the polishing method of this embodiment is applied to a polishing mechanism of a linear polishing system. FIG. 3 schematically illustrates a polishing apparatus of a linear polishing system. As shown in FIG. 3, the polishing apparatus of the linear polishing system polishes a to-be-polished object 33 supported by a carrier 32 by pressing the to-be-polished object 33 against an abrasive cloth 31 bonded to a belt and driving the belt and rotating the carrier 32 while supplying an abrasive 34 to the abrasive cloth 31. The abrasive cloth 31 is dressed by pressing a dressing member 35 against the abrasive cloth 31 during polishing and moving the dressing member 35 orthogonally to the direction along which the belt is driven.

A motor 36 for driving the belt to which the abrasive cloth 31 is bonded is connected to a monitoring tool 37 for always monitoring the torque current of the motor 36, and values of the torque current during polishing can be stored, as data, in the monitoring tool 37.

Figure 4:
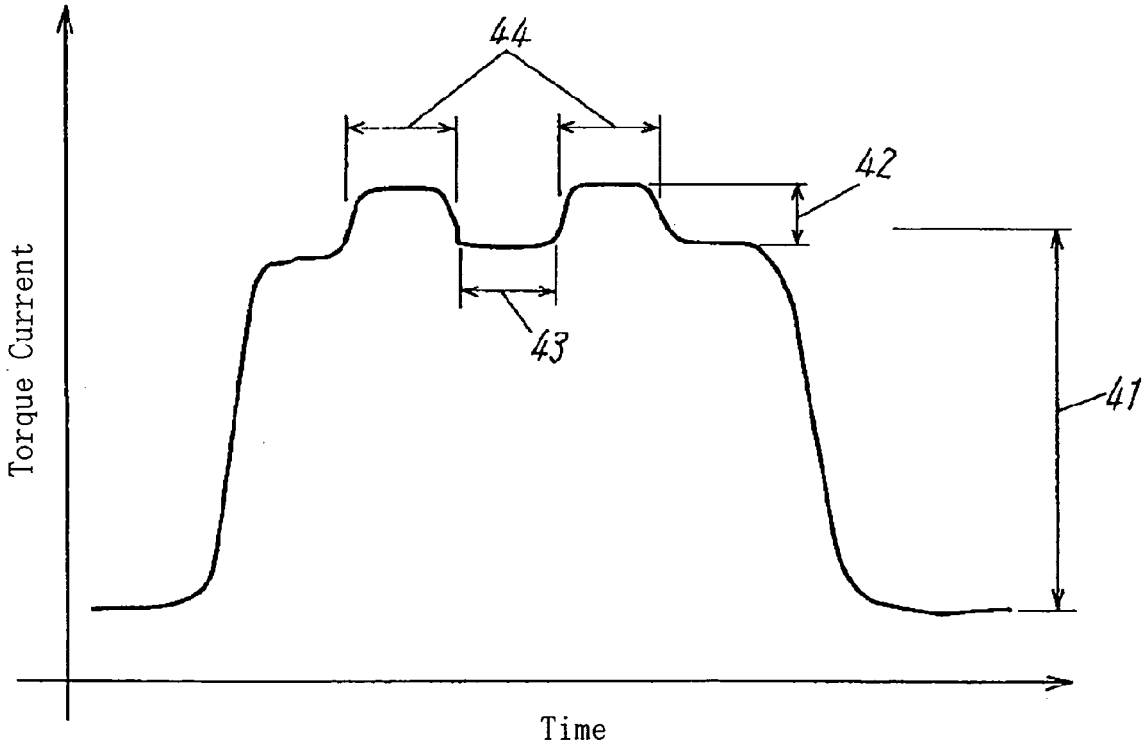
FIG. 4 is a graph showing a result obtained by measuring a torque current in the polishing method according to the embodiment of the present invention.

FIG. 4 illustrates an example in which the torque current of the motor 36 is measured when the abrasive cloth 31 is dressed during polishing. A friction is produced between the to-be-polished object 33 and the abrasive cloth 31 at the start of polishing. This increases the torque current of the motor 36 by an increment 41 shown in FIG. 4. A friction is produced between the dressing member 35 and the abrasive cloth 31 by dressing the abrasive cloth 31 during polishing. This further increases the torque current of the motor 36 by an increment 42 shown in FIG. 4. Furthermore, the torque current is returned to the torque current before the start of dressing at the expiration of each of dressing periods 44. When the abrasive cloth 31 is again dressed after an interval 43 shown in FIG. 4, this again increases the torque current.

The increment 42 of the torque current shown in FIG. 4 is determined based on the friction between the dressing member 35 and the abrasive cloth 31. More particularly, when the wearing-out of the dressing member 35 reduces the friction between the dressing member 35 and the abrasive cloth 31, this decreases the increment 42. In view of the above, the deterioration of the dressing member 35 can be sensed by monitoring the progression of the increment 42 of the torque current. The time at which the increment 42 of the torque current falls below a previously set value corresponds to the time at which the deteriorated dressing member 35 can be appropriately replaced. The appropriate replacement of the dressing member 35 can prevent reduction in the polishing rate, abnormal polishing of the to-be-polished object 33 and the discarding of a dressing member 35 that has not been deteriorated.

A threshold increment of the torque current for replacing a dressing member need be set by dressing an abrasive cloth using a previously deteriorated dressing member.

Figure 5:
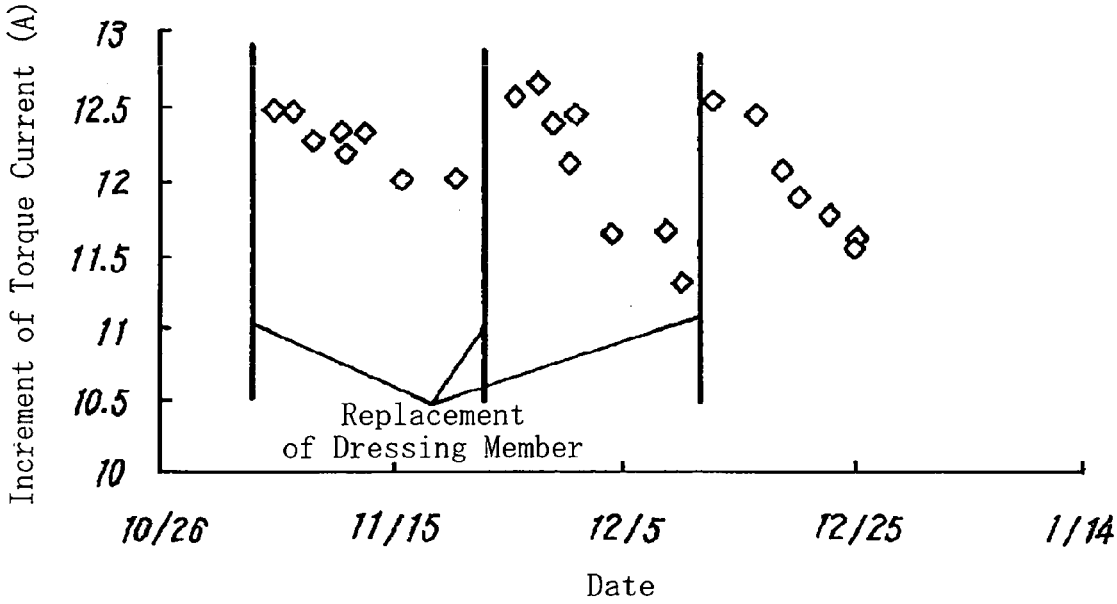
FIG. 5 is a graph showing the correlation between the time during which a dressing member is used and a torque current in the polishing method according to the embodiment of the present invention.

FIG. 5 illustrates a result obtained by actually polishing a substrate using the substrate polishing method according to this embodiment. As shown in FIG. 5, with an increase in the time during which a dressing member is used, the increment of the torque current is decreasing. In view of the above, the deterioration of the dressing member can be detected. As a result, the dressing member can be appropriately replaced.

As described above, the polishing method of the present invention can restrain abnormal polishing of a to-be-polished object due to the deterioration of a dressing member, makes it possible to appropriately replace a dressing member according to individual differences among the lives of dressing members and is useful as a polishing method for a chemical mechanical polishing (CMP) step in which a semiconductor wafer surface is planarized.

What is claimed is:

1. A polishing method comprising the steps of:

(a) polishing a to-be-polished object by moving an abrasive cloth relative to the to-be-polished object while pressing the to-be-polished object against the abrasive cloth;

(b) pressing a dressing member against the abrasive cloth moving relative to the to-be-polished object with the to-be-polished object pressed against the abrasive cloth and relatively moving the abrasive cloth and the dressing member, thereby dressing the abrasive cloth while polishing the to-be-polished object; and (c) determining the difference between a torque current of a motor in the step (a) and the torque current of the motor in the step (b), and replacing the dressing member when the determined difference falls below a previously set value.

* * * * *